US008094848B1

(12) United States Patent
Frerking et al.

(10) Patent No.: US 8,094,848 B1
(45) Date of Patent: Jan. 10, 2012

(54) AUTOMATICALLY CONFIGURING HEARING ASSISTIVE DEVICE

(75) Inventors: Melvin Duane Frerking, Norcross, GA (US); George O'Quinn Hirvela, Carrollton, GA (US)

(73) Assignee: AT&T Mobility II LLC, Atlanta, GA (US)

( * ) Notice: Subject to any disclaimer, the term of this patent is extended or adjusted under 35 U.S.C. 154(b) by 1400 days.

(21) Appl. No.: 11/379,812

(22) Filed: Apr. 24, 2006

(51) Int. Cl.
*H04R 25/00* (2006.01)

(52) U.S. Cl. ..... 381/315; 381/312; 381/314; 381/323

(58) Field of Classification Search ..... 381/314–315, 381/323
See application file for complete search history.

(56) References Cited

U.S. PATENT DOCUMENTS

| | | | | |
|---|---|---|---|---|
| 4,697,283 | A | 9/1987 | Lafrance | |
| 5,086,464 | A | 2/1992 | Groppe | |
| 5,553,152 | A * | 9/1996 | Newton | 381/328 |
| 5,615,229 | A | 3/1997 | Sharma | |
| 5,835,610 | A | 11/1998 | Ishige | |
| 5,842,115 | A | 11/1998 | Dent | |
| 5,892,836 | A * | 4/1999 | Ishige et al. | 381/316 |
| 5,991,420 | A | 11/1999 | Stern | |
| 6,078,675 | A | 6/2000 | Bowen-Nielsen | |
| 6,240,195 | B1 * | 5/2001 | Bindner et al. | 381/316 |
| 6,694,034 | B2 | 2/2004 | Julstrom | |
| 6,879,695 | B2 | 4/2005 | Maltan | |
| 6,925,179 | B2 | 8/2005 | Waldron | |
| 7,167,571 | B2 * | 1/2007 | Bantz et al. | 381/312 |
| 7,183,924 | B1 * | 2/2007 | Ku | 340/572.1 |
| 2006/0025172 | A1 | 2/2006 | Hawker | |
| 2006/0126873 | A1 | 6/2006 | Lee | |
| 2006/0147069 | A1 | 7/2006 | Svajda | |
| 2006/0188116 | A1 * | 8/2006 | Frerking et al. | 381/315 |
| 2006/0279412 | A1 * | 12/2006 | Holland et al. | 340/10.51 |
| 2007/0067269 | A1 * | 3/2007 | Rudge et al. | 707/3 |

* cited by examiner

*Primary Examiner* — Curtis Kuntz
*Assistant Examiner* — Ryan Robinson
(74) *Attorney, Agent, or Firm* — Parks IP Law LLC; Mickki D. Murray, Esq.

(57) ABSTRACT

An adjustable hearing assistive device that automatically configures to the hearing needs of a user. The adjustable hearing assistive device can be in the form of a hearing aid that includes a presence activated sensor adapted to receive setting data, hearing processing circuitry adapted to receive sound and manipulate an audio signal, and a controller adapted to configure the processing circuitry in response to the setting data so that sound output to a user is in accordance with the hearing needs of the user. The setting data can include settings for a default mode of operation or temporary settings for use when the user is in a particular environment. Setting data can be provided by a hearing profile tag in the form of an RFID tag and the presence activated sensor can be an RFID reader.

15 Claims, 12 Drawing Sheets

AUTOMATICALLY CONFIGURING HEARING ASSISTIVE DEVICE

TECHNICAL FIELD

The present invention relates generally to hearing assistive systems and methods. More specifically, the present invention is directed to automatically configuring a hearing aid based on the unique hearing needs of a user.

BACKGROUND OF THE INVENTION

Hearing aids are used to assist the hearing impaired to hear sounds which they otherwise could not hear. In simple terms a hearing aid is a device worn by a user to pick up and amplify sound and provide it to a user's ear. Hearing aid technology has continually improved, resulting in ever smaller devices which are often categorized by how they fit about a user's ear. For example, some common hearing aid styles listed by decreasing size include behind-the-ear (BTE), in-the-ear (ITE), in-the-canal (ITC), mostly-in-the-canal (MIC) and completely-in-the-canal (CIC) hearing aids.

Today's advanced digital hearing aids can include features such as multiple channels, directional microphones, and programmable digital processors that allow a hearing aid to be configured in accordance with a user's specific hearing deficiencies. For example, in a typical digital hearing aid a microphone picks up sound waves and converts them into electrical audio signals. These electrical audio signals are then converted into digital format by an analog to digital converter and sent to a digital signal processor that manipulates the digital signals. The resulting manipulated digital audio signals can then be converted into analog format by a digital to analog converter, amplified, and output to the user as sound waves via a speaker. If a user has difficulty hearing sounds within a particular frequency range, then the hearing aid settings can be adjusted so that sounds within that frequency range are picked up by the hearing aid, processed, and amplified in accordance with the user's needs.

To configure a hearing aid to a particular user, the user's hearing loss characteristics are determined. This is typically accomplished by an audiologist who administers a hearing exam to determine the extent of a user's hearing loss and develops a hearing profile or audiogram detailing the characteristics of the user's hearing impairment. The audiologist or a technician can then adjust the settings of a hearing aid's electronics in accordance with these hearing loss characteristics. This is typically done using special equipment to store the user's hearing loss profile on the hearing aid's electronics. A proper fit of the hearing aid is also important for both comfort and performance, and the audiologist typically makes ear molds of the patient's ear to ensure a proper fit.

While the aforementioned process can be used to configure a hearing aid to a particular user's hearing needs, it has several drawbacks. For example, a user cannot simply update his hearing aid with a new prescription but must employ an audiologist to configure the hearing aid. This is not only expensive but also inconvenient, especially for the large number of hearing aid users who are elderly, infirm, or disabled. Furthermore, it is presently not practical to update the electronics of a hearing aid. Instead, a user must purchase an entirely new hearing aid and engage an audiologist to have it configured and fitted. Thus, many hearing aid users fail to update their hearing aids because they do not want to take a trip to the audiologist and incur the expense of new ear molds and housings. Furthermore, when a user seeks to have a hearing aid repaired he often must leave the hearing aid with a technician; consequently the user is left without a hearing assistance device.

Audiologist configuration of hearing aids can add a layer of complexity and inconvenience to the hearing aid purchase. A potential purchaser may be reluctant to buy a new hearing aid because he does not want to make a trip to the audiologist or endure a fitting procedure. However, if a hearing aid could be automatically configured to a user's hearing loss prescription, then hearing aids and components could be marketed through other venues as well as through an audiologist.

Furthermore, there is currently no system that provides a hearing aid manufacturer with the ability to sell hearing aid electronics circuitry to a customer independently of the hearing aid shell. Thus, a user that is content with his current hearing aid fit but wants to update the hearing aid electronics is unable to simply update the electronics. If a new hearing aid is purchased its settings must be adjusted by an audiologist to configure the hearing aid to the user's hearing loss profile and the hearing aid housing must be fitted to the user's ear. In addition, manufacturers produce different types of circuitry for different hearing aid styles, preventing the benefits of economies of scale offered by a one type fits all design.

As discussed above, a hearing aid can be loaded with a user's hearing loss profile to configure the hearing aid to the user's needs. Another factor that plays a role in determining the proper settings of a hearing aid is the environment in which the hearing aid is worn. For example, a first setting can be appropriate when the user is in a crowded restaurant, while a second setting can be preferred when the user is attending a classroom lecture or a concert. Thus, there can be situations in which the user would like to adjust the hearing aid's settings based upon the particular environment in which it will be used. However, it would be impractical to have an audiologist temporarily adjust the settings of the hearing aid.

Considering the above, what is needed is a system and method for automatically configuring a hearing aid to the needs of a user. What is also needed is a hearing aid that can be adjusted to a user's needs without the assistance of an audiologist. There is a need for a hearing aid whose settings can be easily adjusted to different environments in which the hearing aid will be used, as well a need for a system and method that allows a user to purchase hearing aid electronics independently of the ear molded housing so that the electronics can be updated and configured without a fitting or adjustment by an audiologist. What is also needed is a system and method that allows a hearing aid manufacturer to manufacture electronic components that fit a plurality of different types of hearing aids, thus achieving economies of scale. There is also a need for a system and method that provide a user a hearing loss profile for use with a hearing aid and the ability to update a hearing aid with a hearing loss profile without the assistance of an audiologist.

SUMMARY OF THE INVENTION

The present invention provides a system and method for configuring a hearing aid in accordance with a user's particular hearing loss characteristics. In exemplary embodiments, the systems and methods described herein are directed to controlling one or more characteristics of a hearing aid based on the unique needs of the user. In one embodiment, a system claimed herein includes an Automatically Configurable Hearing Assistive Device (ACHAD) and a Hearing Profile Tag (HPT).

As taught herein, an ACHAD is a hearing assistive device capable of receiving sound, converting it to an audio signal, and processing the audio signal in response to the particular hearing needs of the user. By way of example and not limitation, an ACHAD can be a hearing aid worn at a user's ear. Further, an ACHAD is configured to interface with and operate in response to a hearing loss profile (HLP), or in response to the absence thereof.

In exemplary embodiments, an HPT worn by or associated with a hearing impaired user is interrogated or read by the ACHAD to determine an HLP for that user. The HLP can be stored on an RFID tag or similar device, which itself can be, or can be integral to, the HPT. In some embodiments an HPT can be worn by the hearing impaired user as an accessory, such as a jewelry item, eyeglasses, an earring, etc.; affixed to a user's ear, head, or hand; implanted under the skin; or otherwise located near the user's ear. In some embodiments, more than one HPT can be associated with a user; for example, when a user requires a different ACHAD for each ear. In one exemplary embodiment the HPT is in the form of eyeglasses worn by a user. In other exemplary embodiments the HPT is in the form of a module removably engagable with the ACHAD to form a hearing aid assembly.

An HPT can include a user's specific HLP or an indicator that represents a typical hearing loss profile. HLPs can be created through hearing tests administered by an audiologist, or by automated testing methods. For example, hearing tests could be provided at kiosks or over the internet to determine a user's hearing loss profile. For example, a user could don a pair of head phones and respond to sound stimulus output at the headphones in accordance with a hearing examination computer program by pressing an input means at a computer terminal. For example, a series of stimuli at different frequencies could be provided to each ear and the user instructed to execute a predetermined response upon hearing the stimuli, such as pressing a left or right button. The user's input could then be analyzed to generate a HLP. For example, a user's failure to respond when a stimuli of a particular frequency is provided to an ear can be indicative of hearing loss in that ear for that frequency. The HLP could then be stored on an HPT and provided to a user. Alternatively, the user could be provided with the HLP in some form, such as a written prescription, that allows the user to purchase an HPT with the corresponding HLP.

HLPs tailored to specific environments in which the hearing aid will be used can also be provided. For example, a user can have different HLPs for different environments. The HLPs associated with different environments can be referred to as Environment Specific Hearing Loss Profiles (ESHLP). For example, a user can have an HLP that is appropriate for most situations which will be referred to herein as a Default Hearing Loss Profile (DHLP). The DHLP can be stored on an HPT that is commonly proximate the user, such as an HPT stored under a user's skin or in a pair of eyeglasses that a user typically wears. An ESHLP can be provided for situations in which the environment requires a change of the desired settings. For example, an ESHLP can be provided on a pair of safety goggles that a user wears in a particular working environment. Thus, while a user can have a single DHLP that configures an ACHAD for most situations, a user can have multiple ESHLPs that temporarily adjust the configuration of a hearing aid for a particular environment.

Alternative exemplary embodiments of apparatus and systems that incorporate an HPT are taught herein. In exemplary embodiments, the ACHAD is in the form of a hearing aid and comprises: a presence activation sensor for interrogating, reading, or otherwise communicating with a separate HPT to receive setting data; processing circuitry to receive sound and convert it to an audio signal and manipulate the audio signal in accordance with device settings; and a controller to receive setting data and adjust the settings of the processing circuitry accordingly. It is noted that a receiving device of the processing circuitry can receive sound in a variety of forms, such as by way of example and not limitation, sound waves or electromagnetic impulses. For example, the receiving device can be a microphone the picks up audible sound or a telecoil that picks up electromagnetic impulses. The processing circuitry can also include analog and digital converters, digital signal processors, amplifiers, filters, dividers, and other hearing aid components known in the art that are used to process an audio signal in accordance with the hearing deficiencies of a user. The controller can comprise a processor and a memory wherein the processor can be separate or included as part of an integrated circuit with the processing circuitry processor. In operation, the ACHAD delivers an audible output to a user according to the parameters defined by the HPT.

In one exemplary embodiment the ACHAD is in the form of a behind-the-ear (BTE) hearing aid having an RFID tag reader for reading an RFID tag located at some other structure in close proximity to the BTE hearing aid, such as a pair of glasses. For example, an RFID tag containing an HLP can be located on the earpiece handle portion of a pair of glasses. In that case, a user can have multiple pairs of glasses having different HLPs stored thereon, such as different HLPs for different environments. The ACHAD interrogates the tag, retrieves the HLP, and configures itself in response to the HLP. Furthermore, an RFID tag can be placed on each of the two handle portions of the glasses to provide a different HLP for each hearing aid in the case where a user wears two hearing aids.

In another exemplary embodiment the ACHAD is in the form of an Adjustable Hearing Assistive Module (AHAM). The AHAM defines an interchangeable first portion of a hearing aid housing that is removably engagable with a second portion of a hearing aid housing so that the first and second portions combine to form a hearing aid assembly. In one exemplary embodiment the second portion of the hearing aid housing includes an HPT. In one embodiment the AHAM housing includes an ear-molded portion of the hearing aid and an HPT in the form of a RFID tag is provided on an interchangeable second portion. Thus, an HPT having a first HLP can be disengaged from the AHAM, removed, and replaced with a second HPT having a second HLP. The AHAM then adjusts from the first to the second HLP to form an updated hearing aid assembly. This allows a user to update the prescription of the AHAM without requiring a new fitting, as the AHAM with its ear-molded housing remains as the HPT is replaced. By automatically adjusting the AHAM to the HLP of the newly added HPT the present invention allows the configuring of a hearing aid to the specific needs of a user without the assistance of an audiologist.

In another embodiment the AHAM is on a first interchangeable portion of a hearing aid that engages with an ear molded second portion containing an HPT. In this case, the AHAM can be replaced by a new AHAM which is automatically configured to the HLP stored in the HPT. This allows a user to easily update the electronics of a hearing aid without having to purchase an entire hearing aid or take the hearing aid to an audiologist to be configured with the user's HLP or fitted for the user's ear. It is contemplated that the aforementioned AHAM module can be configured to fit with a variety of hearing aid styles thereby enabling a manufacturer to produce a single version of electronics circuitry that is suitable for all hearing aid styles thereby providing economies of scale.

In an exemplary method, the ACHAD can operate in a default mode prior to the configuration of the device in response to the user's specific hearing deficiencies. When the ACHAD comes within communication range of an HPT, which could be restricted to a very short distance, the ACHAD could detect the presence of the HPT and obtain the hearing assistive information, such as an HLP, from any of a variety of known methods, and in response, configure itself to modify its settings so that it will accommodate the needs of the particular user. Furthermore, if the HPT includes information regarding the particular environment, such as an ESHLP, the ACHAD can configure the settings in response to the particular environment as well.

Alternative exemplary embodiments of methods that incorporate an ACHAD are taught herein. In one embodiment the HPT is a presence activation device that includes a HLP. In this embodiment, the ACHAD is activated in response to a communication from the HPT, including the transfer of the HLP stored on the HPT. In response to receiving the HLP, the ACHAD operates in an enhanced mode according to the HLP parameters.

Another exemplary embodiment of a method incorporates an ACHAD that can switch between enhanced modes of operation and default modes and can update the default settings of the ACHAD. There, the HPT is a presence activation device that includes a HLP. The HLP can be a DHLP associated with default settings to be stored on the ACHAD or an ESHLP associated with temporary settings for an enhanced mode associated with a particular environment. The ACHAD can be activated in response to a communication from the HPT, including the transfer of an HLP. In response to receiving an ESHLP, the ACHAD can operate in an enhanced mode according to the setting data provided by the ESHLP until the HPT is moved beyond range of the ACHAD. In response to receiving a DHLP the setting data received from the DHLP can be stored as default settings for the ACHAD and the ACHAD operates in a default mode. Thus an HLP can include an indicator as to whether the setting data should be stored as the default settings of the ACHAD.

DETAILED DESCRIPTION

As required, detailed embodiments of the present invention are disclosed herein. It must be understood that the disclosed embodiments are merely exemplary of the invention that can be embodied in various and alternative forms, and combinations thereof. As used herein, the word "exemplary" is used expansively to refer to embodiments that serve as an illustration, specimen, model or pattern. The figures are not necessarily to scale and some features can be exaggerated or minimized to show details of particular components. In other instances, well-known components, systems, materials or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Generally speaking, the systems and methods described herein are directed to configuring—based on the unique needs of a user—one or more settings of a hearing assistive device. For purposes of teaching and not limitation, the illustrated embodiments are directed to a hearing assistive device in the form of a hearing aid that automatically adjusts its settings to accommodate or compensate for the unique hearing needs of the user.

Figure 1:
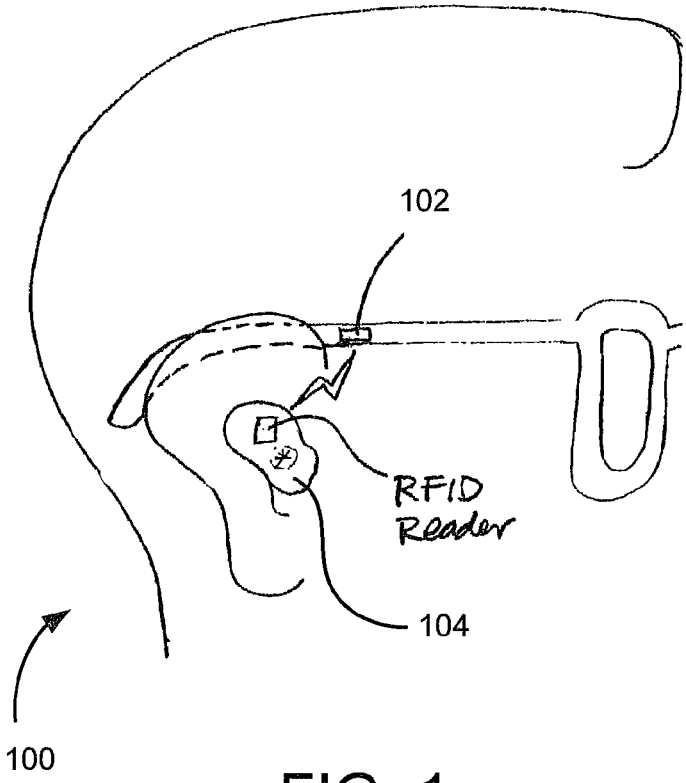
FIG. 1 illustrates an embodiment of an Automatically Configuring Hearing Assistive System in accordance with the present invention.

Referring now to the drawings, wherein like numerals represent like elements throughout, FIG. 1 illustrates a hearing impaired user interacting with an Automatically Configuring Hearing Assistive System (ACHAS) 100. The illustrated ACHAS 100 can comprise a Hearing Profile Tag (HPT) 102 and an Automatically Configuring Hearing Assistive Device (ACHAD) 104. As described in detail below, an HPT 102 acts as trigger device that, when in proximity to an ACHAD 104, signals the ACHAD 104 to operate in a given manner.

An HPT 102, as a trigger or a means for presence activation can take any of many known forms, including: a magnet; a pre-determined light source such as but not limited to a laser, LED, ultra-violet, or infra-red light; a predetermined sound signal or frequency; a radio-frequency identification (RFID) device; or any type of sensor including temperature and moisture. The illustrated HPT 102 is in the form of an RFID tag embedded in an eyeglass frame. As understood by those skilled in the art, RFID tags are available in many variations and forms, including active, passive, semi-passive, and chipless. One purpose of an RFID tag is to store information, such as information related to the person wearing the RFID tag, which can be accessed or retrieved upon demand. One type of information related to the person that can be stored on a RFID tag for future access and use includes health related data such as past medical records, present medical needs, and future medical instructions.

A hearing impaired person is, generally speaking, considered to be someone with a diminished ability to hear without corrective means. In some cases the diminished ability is severe. As previously discussed, a trained audiologist can evaluate the person's hearing loss and related disorders, and then manage a corrective regimen, including the dispensing of hearing aids and other corrective means. In the course of evaluating the patient's hearing loss, the audiologist typically prepares an audiogram or similar type of profile that describes the hearing loss. A person's Hearing Loss Profile (HLP) is one type of health-related data that can be stored on an HPT 102.

The HPT 102 RFID tag can be a passive, read-only tag. Alternatively, in some embodiments, an active tag can be used. Passive tags are not self-powered and are activated, typically, only upon interaction with an RFID reader. As understood by those skilled in the art, when radio waves from a reader reach a microchip antenna, the energy from those waves is converted by the antenna into electricity, which is used to power up the microchip in the tag. The tag is then able to send back information stored on the microchip. Here also, for the purposes of teaching and not limitation, the information stored on the microchip of the passive tag in the HPT 102 is related to the hearing characteristics of the user, that is, the user's HLP.

Embodiments of the ACHAS 100 can include any variation of an HPT 102. Further, embodiments of the HPT 102 can take various forms. For example, an HPT 102 in the form of an RFID tag can be worn on the person by being embedded in jewelry or similar wearable items including necklaces, earrings, piercings, watches or watch bands, bracelets, rings, cuff links, clothing, hats, scarves, neck ties, buttons, decorative pins, hair accessories including weaves and wigs, eyeglasses, and the like. Likewise, a very small HPT 102 can be attached directly to a user's skin using adhesive or adhesive devices. Further, because implantable RFID's are extremely small, an HPT 102 can be implanted in or under a user's skin. Alternatively, an HPT 102 can take any form comprising any means for presence activation and simply be positioned proximate to the ACHAD 104. Furthermore, the ACHAS 100 can include more than one ACHAD and more than one HPT as in the case where a user has hearing loss in both ears.

Embodiments of the ACHAD 104 can include any variation of a hearing aid. Here, the illustrated ACHAD 104 of FIG. 1 is in the form of an in-the-ear (ITE) hearing aid, but as understood by those skilled in the art, an ACHAD 104 can comprise any hearing assistive device equipped to pick up and transmit any distinguishable sound wave. Such sound waves can generally fall in the range of human hearing (approximately 10 Hz to 20 KHz).

As described in greater detail herein, the ACHAD 104 can be equipped with apparatus that receive and process the information stored in and transmitted by the HPT 102. Thus, a user associated with an HPT 102 can be identified by an ACHAD 104 when that user is sufficiently close to the ACHAD 104. In some embodiments, the ACHAD is caused to interrogate a nearby HPT by the pressing of a button or other manual activation process. Prior to discussing the apparatus regarding the ACHAD 104, the methods of operation directed to various embodiments of an ACHAS 100 will now be explained.

Figure 2:
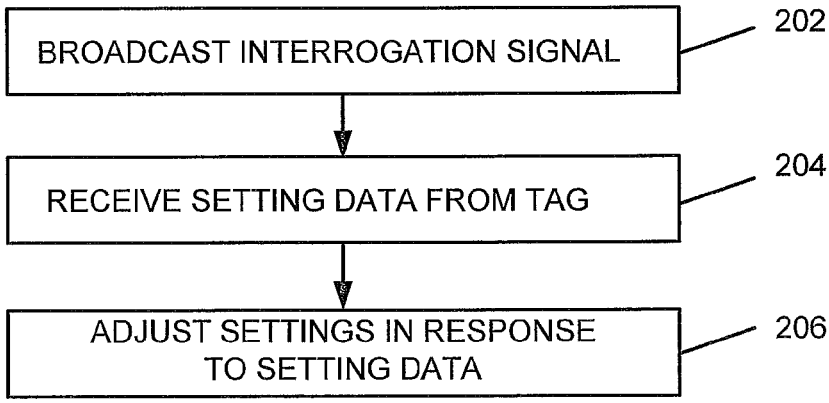
FIG. 2 illustrates a flowchart of a method of an exemplary embodiment of the present invention.

FIG. 2 shows an exemplary embodiment of a method of the present invention in which an ACHAD 104 is configured to the requirements of a particular user. At block 202 an interrogation signal is broadcast. The interrogation signal can be a signal from an RFID reader within the ACHAD 104 to be used to interrogate an RFID tag of an HPT 102. If an HPT 102 is present then at block 204 information from the HPT 102 such as information regarding the user's hearing loss characteristics is retrieved. For example, the information could include a HLP associated with the wearer of the ACHAD 104. As discussed further below, the information can also include additional information, such as information for adjusting the settings in accordance with a particular environment. At block 206 the ACHAD 102 is configured in accordance with the data retrieved from the HPT 102. For example, if the HPT 102 provides an HLP to the ACHAD 104 the settings are adjusted in accordance with the HLP.

Figure 3A:
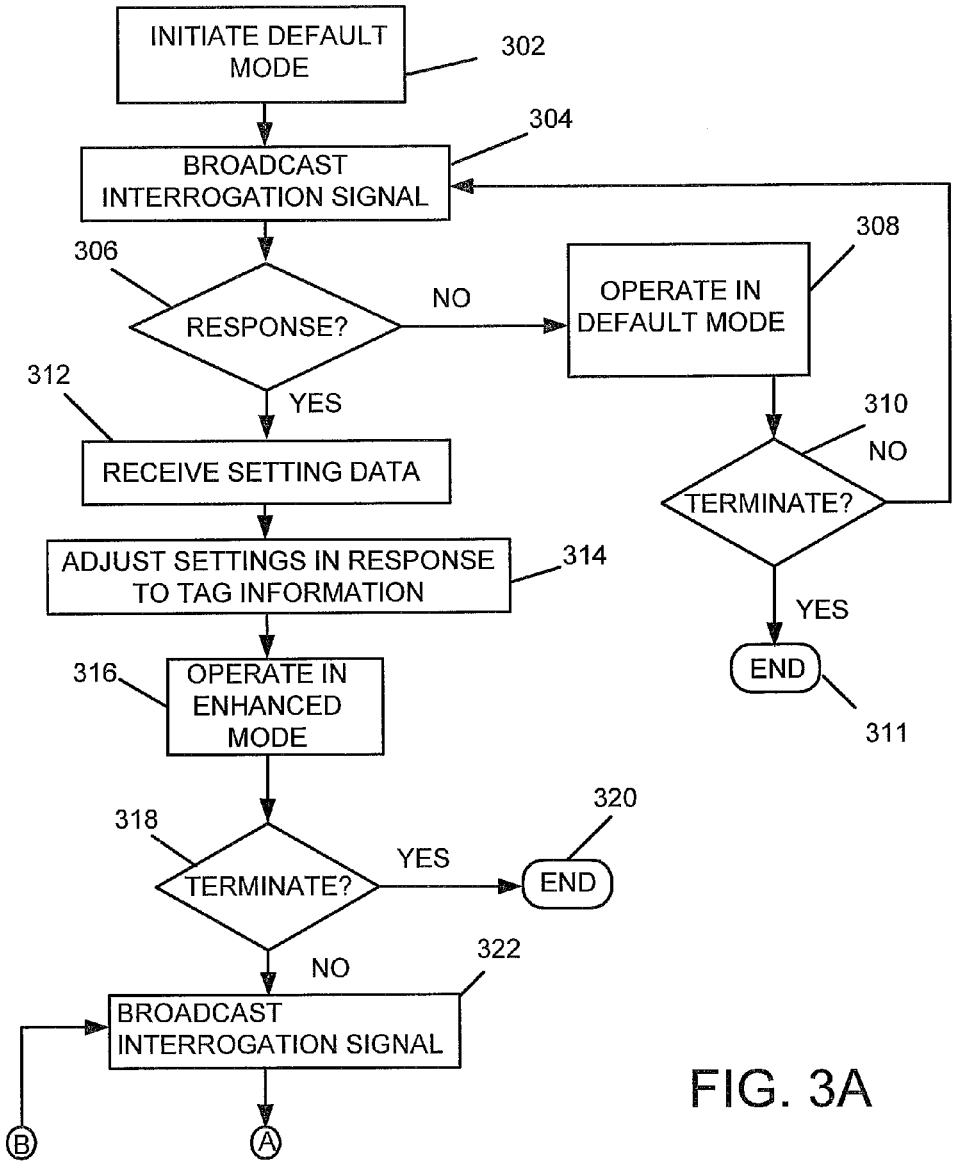
FIGS. 3A and 3B illustrate a flowchart of a method of an exemplary embodiment of the present invention.
Figure 3B:
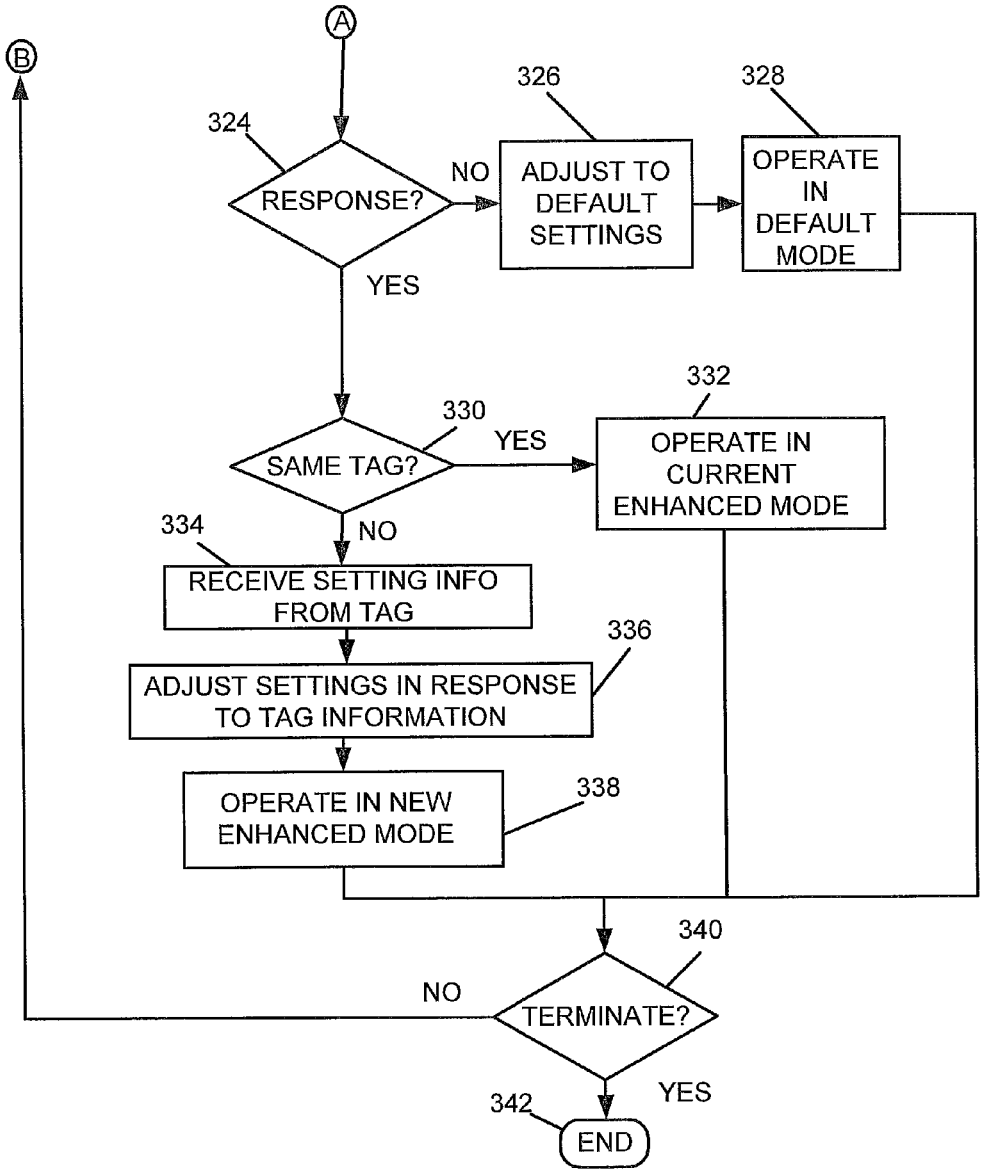

Turning to FIGS. 3A and 3B, another exemplary method of the invention is provided. In block 302 the operation of the ACHAD 104 is started, such as by switching the hearing aid to an "on" state. The ACHAD 104 enters a default mode of operation in which it operates under its default settings to receive, manipulate, and output sound for a user. The default mode can be considered a base mode of operation in which the hearing aid operates when first powered up. It can continue to operate in the default mode if additional setting information is not received. Upon the first use of the ACHAD 104 the default settings may not be specifically tailored to the user's specific hearing loss characteristics. For example, during manufacture of an ACHAD 104 its settings can be set to some predetermined criteria not necessarily associated with the specific user. The ACHAD 104 can be mass manufactured and provided with initial default settings. By way of example and not limitation, the initial default settings can be in accordance with hearing loss characteristics prevalent in a large portion of hearing-impaired population or in accordance with the characteristics of the non-hearing impaired. As discussed in detail below, the settings of the ACHAD 104 can be adjusted in accordance with the needs of the particular user and, if appropriate, are saved as default settings so that upon the next use of the device the new default settings are employed. For example, it is contemplated that an ACHAD could be purchased directly from a manufacturer, from a retail store, mail order, or by other means and automatically configured to a user's hearing loss without the need of an audiologist.

At block 304 the ACHAD 104 broadcasts an interrogation signal. In this exemplary embodiment the signal can sent be from an RFID reader within the ACHAD 104 to energize an RFID tag within a predetermined proximity. The interrogation signal can be broadcast upon start up, at predetermined time intervals, intermittently, randomly, upon the press of a button, or at some other time intervals.

A check is made at block 306 as to whether a response is received back from the interrogation signal. For example, it is determined whether an RFID tag within the range of the broadcast signal provides a response that is received by the RFID reader of the ACHAD 104. While discussed here as a passive tag, the HPT 102 could also be an active tag wherein the tag transmits data without having to be energized by the ACHAD 104.

If no response is received, the ACHAD 104 continues to operate in a default mode 308 according to the default settings. If the user elects to terminate the session at block 310 then the session is terminated at block 311. Otherwise, an interrogation signal can again be broadcast (block 306) and again a determination made whether a response is received. This interrogation signal can also be broadcast at predetermined time intervals, intermittently, randomly, upon the press of a button, or at some other time intervals.

If a response is received at block 306 such as a response from an HPT including setting data, then the response is analyzed and the included data setting is received at block 312. The setting data can include data for adjusting the settings of the ACHAD 104. For example, the setting data can include a user's HLP detailing the particular hearing loss characteristics of the user so that the settings of the ACHAD 104 can be adjusted accordingly. The setting data can also include other information for adjusting the settings of the ACHAD 104 such as information for adjusting the ACHAD 104 to a particular environment. For example, the setting data can include information for adjusting the settings of the ACHAD 104 for use by a user in a classroom lecture, a crowded restaurant, or a sporting event. Thus, the ACHAD 104 can be configured not only to the particular hearing loss characteristics of the user but also the environment in which the ACHAD 104 is used.

Once the configuration data is received from the HPT 102 the settings of the ACHAD 104 can be adjusted in response thereto at block 314. For example, the ACHAD 104 can have a library of digital processing programs for processing sounds picked up by the ACHAD 104 and can select a processing program in response to the setting data. The ACHAD 104 can also adjust the settings of other hardware devices such as microphones, amplifiers, speakers, filters, and converters in response to the setting data. For example, if the setting data provides data that a user has a hearing impairment for sounds of a particular frequency range then the microphone can be adjusted to pickup sounds in that frequency range, or if the setting data is for an environment for a lecture the orientation of the microphone can be adjusted accordingly. After the adjustments the ACHAD 104 operates in an enhanced mode at block 316.

If a decision is made to terminate at block 318 then the session is terminated 320. If there is no decision to terminate, then another interrogation signal can be broadcast at block 322.

As shown in FIG. 3B, a test whether a response is received can be made at block 324. If no response is received then the ACHAD settings are set to the current default settings at block 326 and the ACHAD 104 operates in a default mode 328. Thus, non-default settings are employed as long as there is a response from an HPT 102 including the non-default setting.

If a response is received from the HPT 102 at block 324, then at block 330 a determination is made as to whether the response received is from the same tag as that previously received at block 306. If it is the same response, then there is no need to change the settings of the ACHAD 104 and the ACHAD 104 continues to operate in the enhanced mode 332. A determination whether to terminate can be made at block 340, and if selected, the process is terminated at block 342. Otherwise, another interrogation is be transmitted at block 322 and the process repeated.

If the response at block 330 is not from the same tag or it is not the same response, then the setting data information is received by the ACHAD 104 at block 334 and the ACHAD 104 is configured in accordance with the setting data at block 336 so that the ACHAD 104 operates in a new enhanced mode at block 338. At block 340 a decision is made whether to terminate. If termination is selected, then the process ends at block 342. Otherwise, another interrogation signal is broadcast at block 322 and the process repeated.

Figure 4A:
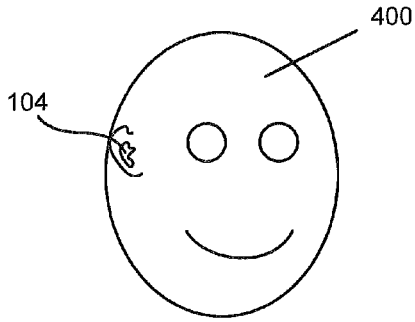
FIG. 4 illustrates an exemplary use of the invention by a user.

An example of the flow of FIGS. 3A-3B will now be described with respect to FIGS. 4A-4D. FIG. 4A shows a user 400 with an ACHAD 104. Because there is no HPT 102 in proximity to the ACHAD 104 the ACHAD 104 will initially operate in a default mode. When an interrogation signal is broadcast 304 there will be no response 304 and thus the ACHAD 104 will operate in the default settings mode 308. For example, if this is the first time that the ACHAD 104 has been used then the default settings from the factory can be used in the default mode.

Figure 4B:
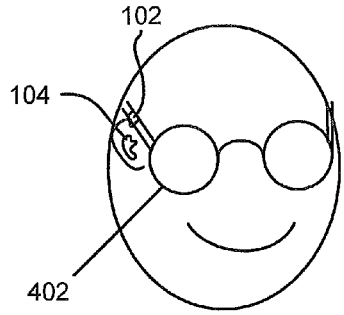
Figure 4C:
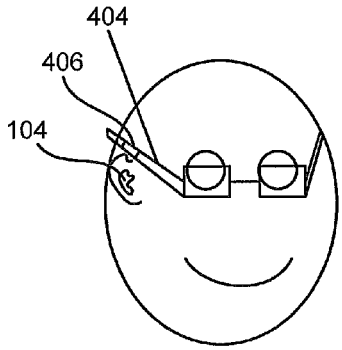

As shown in FIG. 4B, an HPT 102 in the form of an RFID tag can be associated with a pair of HPT eyeglasses 402 worn by a user and placed in proximity to the ACHAD 104. If the user has not terminated use of the ACHAD 104 such as by turning the power off, then when the next interrogation signal is broadcast 304 a response from the HPT 102 is received 306 by the ACHAD 104, the setting data is received 312, and the settings of the ACHAD 104 adjusted 314 so that the ACHAD 104 operates in a first enhanced mode 316. If the session is not terminated then another interrogation signal is broadcast 322. If there is no response to this interrogation signal 324, such as in the case where the user removes the HPT eyeglasses 402 from proximity of the ACHAD 104, then the settings are returned to the default settings 326 and the ACHAD 104 operates in a default mode 328. If the eyeglasses are not removed, then the same signal is received 330 and the ACHAD 104 continues to operate in the enhanced mode in accordance with the HPT 102. If however, the user replaces the first HPT eyeglasses with another pair of HPT eyeglasses 404 having a second HPT 406 as shown in FIG. 4C or otherwise replaces the HPT 102 with a new HPT 406, then new setting data associated with the new HPT 406 will be received 334 and the ACHAD 104 settings will be adjusted 336 so that the ACHAD 104 operates in a new enhanced mode 338. For example, this can occur when a user wants to change the settings of an ACHAD based on a particular environment. In this case the second HPT 406 can have settings that are best used when attending an outdoor sporting event and the user dons a pair of sunglasses having an HPT.

Figure 4D:
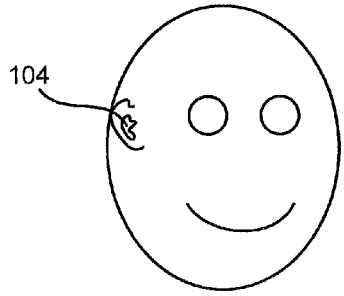

The ACHAD 104 will continue to operate in the new enhanced mode in accordance with the second HPT 406 until the second HPT is removed from the proximity of the ACHAD 104. For example, if the user then removes the HPT sunglasses 404 as shown in FIG. 4D then the settings will return to the default mode as there will be no response to an interrogation signal. If the user puts the first pair of glasses 402 back on as shown in FIG. 4B then the settings would be adjusted in accordance with the first HPT 102 to operate in the first enhanced mode.

While the examples shown in FIGS. 4A-4D show HPT eyeglasses having a single HPT it is contemplated that multiple HPTs and ACHADS could be employed. For example, a user can wear an ACHAD in each ear in which case the HPT eyeglasses can have an HPT on each ear portion of the eyeglass frame. This would allow each of the ACHADs to be used at either ear, as each would automatically adjust to the user's specific hearing loss for that ear in response to the HPT on the eyeglass frame. Thus, it would no longer be necessary to place a particular ACHAD in a specific ear. This can be particularly helpful to vision-impaired users who may have difficulty distinguishing between ACHADs. For example, a user could simply place the ACHADs on a night stand before going to bed. Upon waking, the user could simply place an ACHAD at each ear without regard as to which ACHAD is placed in which ear. The user could then don eyeglasses having two HPTs to configure each hearing aid to the proper settings for each ear.

As mentioned above, an HPT could be placed in proximity to the ACHAD 104 in a number of ways. However, it can be desirable to change the default settings on the ACHAD without requiring an HPT to be proximate the user. For example, a user may desire to change the initial settings of the ACHAD 104 from the manufacturer's settings but without the necessity of having an HPT near the ACHAD 104 to keep those settings. In addition, the user may want to change the settings while in a particular environment but then have the settings return to a default setting when he or she is no longer in that environment. Thus, as described in more detail below, the default settings of the ACHAD 104 can be changed as well as the temporary settings.

Figure 5A:
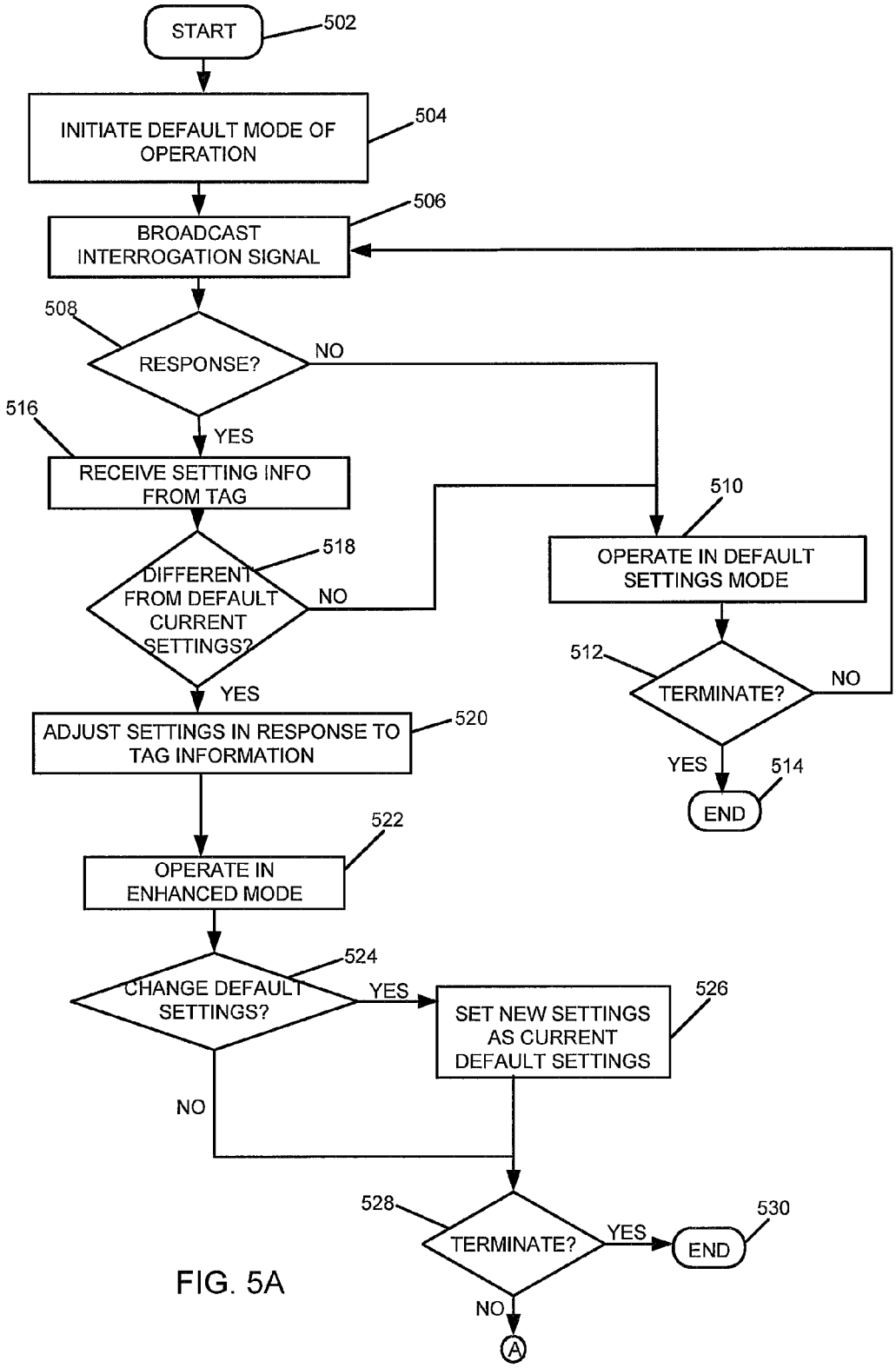
FIGS. 5A and 5B illustrate a flowchart of a method of an exemplary embodiment of the present invention.
Figure 5B:
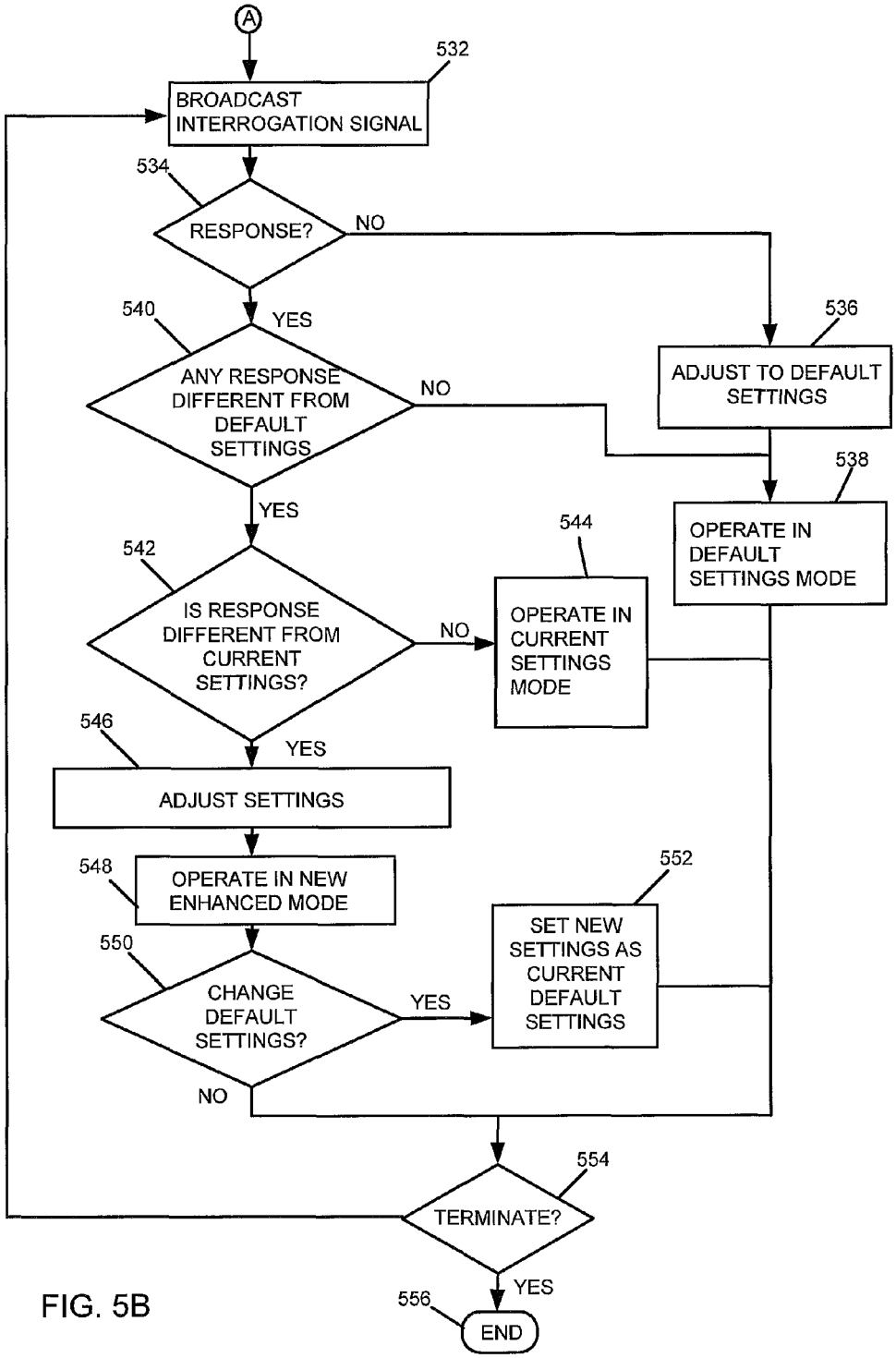

Turning to FIGS. 5A-5B there is shown an exemplary embodiment of a method of the invention in which the default settings are updated. Upon start 502 of operation the ACHAD 104 initiates a default mode of operation 504 in which the settings are set to a default condition. For example, the user can purchase an ACHAD 104 from a manufacturer with preloaded default settings. An interrogation signal is broadcast at block 506 and if there is no response to the interrogation signal then the ACHAD 104 continues to operate with the current default settings at block 510. If the session is not terminated at block 512 then another interrogation signal is broadcast at block 506 as will be described more fully below, otherwise the session is terminated at block 514.

If there is a response from the first broadcast signal at block 508 then the setting data is received at block 516. At block 518 a determination is made whether the settings received are different from the current default settings. If the settings are not different than the current default settings, then the ACHAD 104 continues to operate with the default settings 510. If the settings are different from the default settings, then the settings are adjusted in response to the setting data at block 520 and the ACHAD 104 operates in an enhanced mode 522. The setting data can include metadata that can designate whether the setting data is a new default setting for use even when an HPT is not present or a temporary setting to be used only when the HPT is present. For example, a user can have a hearing exam and get an updated hearing profile. This new hearing profile can then be used to establish new default settings for the ACHAD 104. These default settings can then be stored on the ACHAD 104 and be used when no additional settings are provided. These default settings would be associated with a DHLP. On the other hand, the settings can be of a temporary nature and associated with a particular environment in which the user can operate the ACHAD 104, the setting will be referred to as an ESHLP.

Thus, at block 524 it can be determined whether the new settings should be the default settings. If so, then at block 526 the default settings are updated accordingly. If not, then the default settings are not changed and the ACHAD 104 continues to operate with the current settings based on the setting data. Either way, at step 528 a decision is made whether to terminate. If so, then the session is ended at block 530. It should be noted that if the default settings were updated at block 526 these new default settings will be employed on the next start up of the ACHAD 104. If the session is not terminated at block 528, then a second interrogation signal is broadcast at block 532 (FIG. 5B) and at block 534 a determination is made whether there is a response. If there is no response, then the settings are switched to the default settings at block 536 and the ACHAD 104 operates in default mode 538. If there is a response at block 534 then at block 540 it is determined whether the response is different from the current default settings. If the settings provided by the setting data are not different from the current default settings, then the ACHAD 104 operates in the default settings mode 538. If the response is different from the current default settings then at block 542 a determination is made whether the response is different from the current settings. If the setting data provided is not different from the current settings then the ACHAD 104 continues to operate in the current enhanced mode at block 544.

If the setting data provides different settings than the current setting at block 542 then at block 546 the settings of the ACHAD 104 are adjusted according to the new setting data and the ACHAD 104 operates in the new enhanced mode at block 548. Furthermore, the setting data can include an indicator as to whether the setting data should stored as the new default settings. Thus, at block 550 a determination is made whether the settings should be saved as default settings. If so, then the new settings are saved as the default settings in block 552. A decision whether to terminate is made at block 554 and the session is either terminated at block 556 or a new interrogation signal is transmitted at block 532.

Figure 6A:
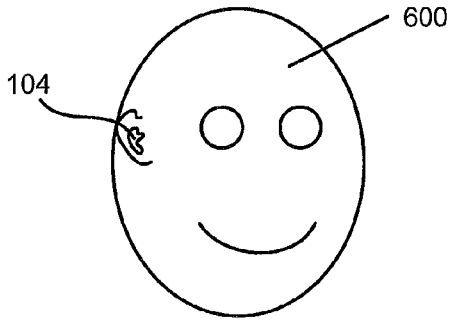
FIG. 6 illustrates an exemplary use of the invention by a user.

An example of a scenario in which the method of FIGS. 5A-5B can be employed is shown in FIGS. 6A-6E. As shown in FIG. 6A, a user 600 can use an ACHAD 104 in the form of an ITE hearing aid. Initially the user can turn on the ACHAD and use it without an associated HPT. In FIG. 6A, when the ACHAD 104 broadcasts an interrogation signal 506 there is no response 508 and the ACHAD 104 operates in a default mode 510.

Figure 6B:
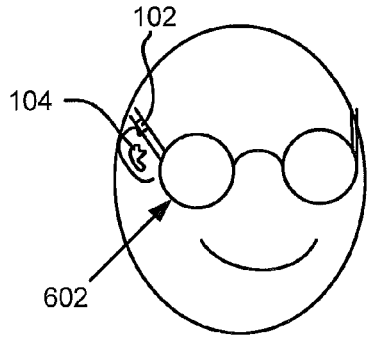

As shown in FIG. 6B the user 600 can don a pair of eyeglasses 602 which can include an HPT 102 in the form of an RFID tag. The RFID tag can include setting data for changing the settings of the ACHAD 104. In this example, the setting data include new default settings for the ACHAD 104. Another interrogation signal is broadcast and the setting data from the HPT 102 is received at block 516. Because the settings are different from the manufacturer's default settings for the ACHAD 104, the ACHAD 104 settings are adjusted in response to the setting data at block 520 and the ACHAD 104 operates in an enhanced mode. As mentioned above, the setting data can include an indicator as to whether the setting data should be stored as the default settings. For example, the setting data from the HPT 102 can replace the default settings provided by the manufacturer. This allows the ACHAD 104 to have default settings tailored to the specific needs of the user even in the absence of an HPT 102. For example, the user would not have to wear the glasses 602 with the HPT 102 to operate in the new default mode as the settings were stored at the device. If an indicator is present in the setting data to update the default settings, then the default settings are updated at block 526. It should be noted that the setting data provided can take a variety of forms including an HLP.

Figure 6C:
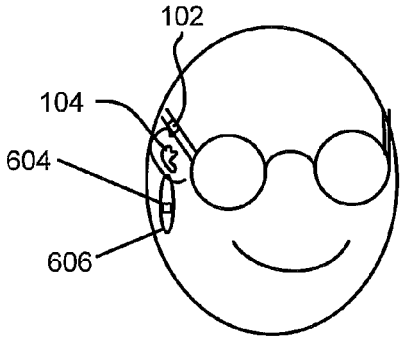
Figure 6D:
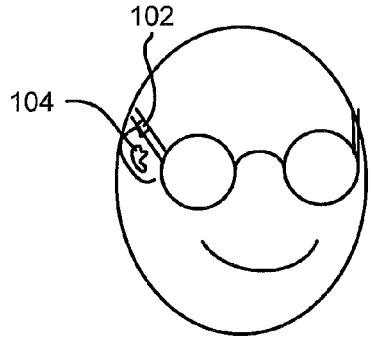

At this point the ACHAD 104 is operating under the new settings provided by the first HPT 102 and has saved those settings as the default settings. As shown in FIG. 6C the user can elect to further adjust the settings of the ACHAD 104 by providing a second HPT with new setting data. For example, the user can desire to adjust the settings of the ACHAD 104 for a particular environment in which the ACHAD 104 will be used such as a sporting event or concert. In this example, a second HPT 604 in the form of a second RFID tag is incorporated into an earring 606 that is used to provide second setting data to temporarily tailor the settings of the ACHAD 104. In this case another interrogation signal is broadcast at block 532.

Figure 6E:
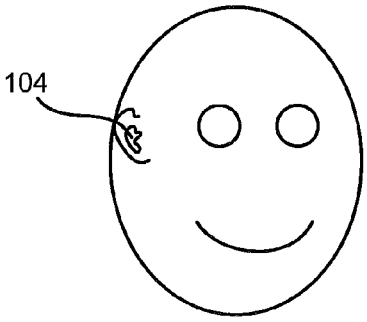

The response from the second HPT 604 is received by the ACHAD 104, such as by an RFID reader, and a determination is made that the second setting data is different from the current default settings and the current settings, and the settings of the ACHAD 104 are adjusted accordingly 546. In this case, because the second setting data is to be used only temporarily and is not meant to replace the default settings, the second setting data is not saved as the default settings but only used as the current settings. This process can then be repeated until the removal of the earring 606 and the HPT 604 so that the ACHAD 104 settings are set to the second setting data until such time as the second HPT 604 is removed from the proximity of the ACHAD 104. At that time the broadcast of the interrogation will reveal a response from the first HPT 102 at block 534. Thus, because the response settings from the HPT 102 are not different from the current default settings provided by the first HPT 102, the ACHAD 104 will adjust the settings to the first HPT settings. Because the first HPT settings were set as the new default settings these will be the settings that are used in the default mode. Thus, after the first HPT 102 is removed from proximity of the ACHAD 104, the ACHAD 104 changes the current settings to the first HPT settings. By saving these first HPT settings as the default settings, the ACHAD 104 can be configured to the user's hearing needs in accordance with the first HPT without requiring the first HPT 102 to be continually present. Thus, even after the user removes the eyeglasses as shown in FIG. 6E so that no HPT is located in the proximity of the ACHAD 104, the ACHAD 104 operates in accordance with the first HPT settings. Of course the default settings can again be adjusted by exposing the ACHAD 104 to another HPT which includes an instruction to save the settings as the default settings. For instance, this can be the case when the user has a new hearing test that produces an updated hearing loss profile and the user dons a pair of glasses with an HPT having new setting data.

Figure 7:
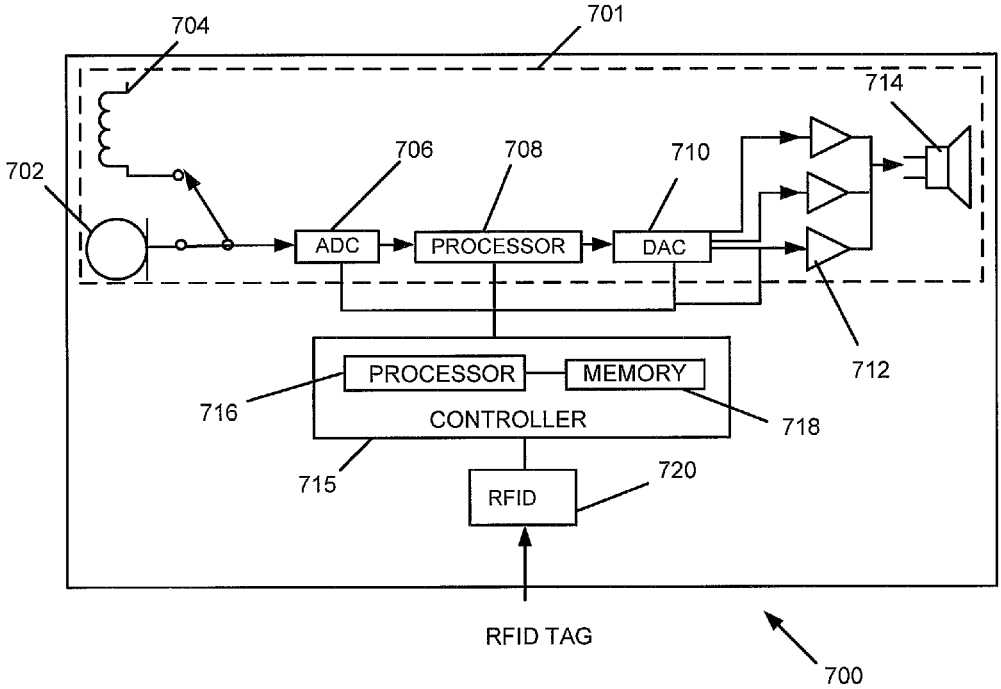
FIG. 7 illustrates a block diagram of an embodiment of an Automatically Configuring Hearing Assistive Device in accordance with the present invention.

Turning now to FIG. 7, an illustrated ACHAD 700 in the form of a hearing aid can include hearing processing circuitry 701 having a microphone 702, telecoil 704, audio to digital converter 706, a digital signal processor 708, a digital to audio converter 710, amplifiers 712, and a speaker 714, all connected by a power and signal bus. In order not to obscure the invention, elements not critical to the present teaching and well understood by those skilled in the art, such as the power supply, are not discussed. In operation, the microphone 702 can pick up sound waves and convert them into electrical signals. These electrical signals can then be converted into digital format by the analog to digital converter 706. The digital signal can then be processed by the digital signal processor 708. The resulting signal can then be converted into analog format by the digital to analog converter 710 and amplified by the amplifiers 712. The amplified signal can then be output to the user as sound waves by the speaker 714.

Preferably the microphone 702 is a directional microphone whose orientation can be changed. It is contemplated that audio signals can also be picked up by the device by other means such as by the telecoil 704 or by an antenna (not shown) or by some other means known in the art and the signal manipulated by the hearing aid circuitry and provided to the user.

The exemplary embodiment of the device shown in FIG. 7 further includes a controller 715 for controlling the settings of the hearing processing circuitry 701. The controller 715 is communicatively coupled to the hearing aid circuitry and controls the settings of the circuitry. For example, the controller 715 can select the program used by the digital signal processor to process signals, send instructions to adjust the orientation of the microphone 702, direct the amplifiers 712 to amplify particular frequencies, and otherwise configure the settings of the hearing aid circuitry in accordance with the particular hearing needs of the user. The controller 715 can include a processor 716 and a memory 718 communicatively coupled to the processor 716. The memory can store particular profiles or settings for use with the controller as described in more detail below.

The illustrated ACHAD 700 further includes a presence activated sensor 720 in communication with the controller memory 718. Further, the memory 718 is in communication with the processor 716. Here, the presence activated sensor 720 is a RFID reader that sends interrogation signals and receives replies from RFID tags, in a manner described herein and as understood by those skilled in the art.

A presence activated sensor 720, as a means for receiving a presence activation signal, is the element in communication with, or that is triggered by, an HPT 102. Means for receiving a presence activation signal include those elements that register or become engaged when in communication with a means for presence activation, including: a magnetic field; a pre-determined light source; a pre-determined sound or signal frequency; any RFID device; any type of sensor such as temperature or moisture, components thereof, and the like.

In embodiments wherein the means for receiving a presence activation signal does not receive or upload information, for example, a normally open switch that is closed by a magnetic field such as provided by an HPT 102 that is a magnet, the closing of the switch can trigger the processor 716 to access and retrieve setting data stored in the memory 718, such as an HLP. It is contemplated that each stored HLP can be uniquely identified with each HPT 102. In an embodiment wherein the means for receiving a presence activation signal does receive or upload stored information, for example, a RFID reader that receives a response signal containing an HLP from a RFID tag in a reader field, the setting data can be transferred directly to the processor.

Memory 718 can store the necessary programs to operate the means for receiving a presence activation signal, as well as related programs required for the operation of the ACHAD 104 and default settings used in the device.

With the setting data loaded onto or otherwise accessible to the controller 715, the illustrated ACHAD 104 is enabled to receive signals and manipulate them according to the unique needs of the hearing impaired user. That is, the ACHAD 104 is configured to operate in the enhanced mode. By way of example and not limitation, speech from a person speaking to a user can be picked up by the hearing aid circuitry, such as via a microphone. The controller having received setting data, such as a HLP, from an HPT adjusts the settings of the hearing aid in accordance with the user's hearing loss characteristics. For example, the controller 716 can adjust the orientation of the microphones 702 in accordance with the setting data so that the microphone picks up sounds that are provided to the user, such as speech of a person talking to the user. The microphones 702 can convert the speech sound electrical signals which can then be converted into digital by the analog to digital converter 706. The resulting digital signal can be processed by the digital signal processor 708 in accordance with the settings established by the controller 715. For example, the controller 715 can instruct the digital signal processor 708 to manipulate the audio signal in a particular way and divide the signal up into particular bands for manipulation by amplifiers 712 or otherwise configure the settings of the ACHAD 104 so that the hearing processing circuitry 701 manipulates the signals to produce an output understandable by the hearing impaired user. Embodiments of the hearing processing circuitry 701 can comprise a graphic equalizer or similarly functional structure.

Upon completing the manipulation of the digital signal, the processor 708 outputs the signal to the converter 710, which returns the signal to audio form prior to outputting to the amplifier 712 that amplifies particular sounds. For example, sound within a particular frequency range associated with a user's hearing loss can be amplified. The amplified signals are then provided to the user as audio at speaker 714.

Figure 8:
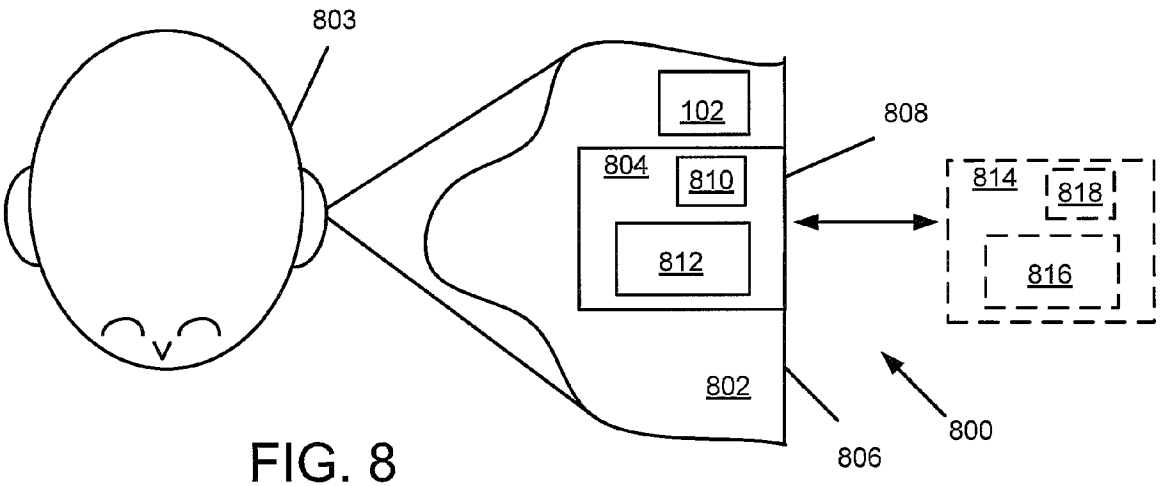
FIG. 8 shows an exemplary embodiment of an Automatically Configuring Hearing Assistive System.

Turning now to FIG. 8, there is shown a Modular Hearing Assistive Device MHAD 800 comprising an ITE hearing aid which includes an HPT in the form of an HPT module 802 and an ACHAD in the form of a Automated Hearing Assistive Module (AHAM) 804, the HPT module 802 and the AHAM 804 together defining first and second engagable portions of the MHAD 800. The HPT module 802 and the AHAM 804 have releasably engagable housings 806; 808 so that the AHAM 804 can be removed from engagement with the HPT module 802 and replaced by another AHAM. For example the AHAM 804 can be snap-fitted with the HPT module 802. The HPT module 802 includes a housing 806 that is form-fitted for a user's 803 ear. For example the housing 806 can be an ear-molded shell.

The HPT module 802 includes an HPT 102 having setting data associated with the user 803 that can be used to configure the AHAM 804. In this example, the HPT module 802 includes an HPT 102 in the form of an RFID tag that includes an HLP for use in adjusting the settings of the AHAM 804.

The AHAM 804 includes a presence activation device 810 and electronics circuitry for picking up and processing sound and outputting audio to a user. So as not to obscure the invention the components of the AHAM are shown as two submodules, a presence activation device 810 in the form of an RFID reader and an electronics module 812 which can include substantially the same components as that shown in the ACHAD 700 of FIG. 7. For example, the electronics module 812 can include a controller, hearing aid processing circuitry, memory, microprocessor, microphone, telecoil, speaker which are all controlled by a power and signal bus.

By making the AHAM 804 removably engagable with the HPT module 802 the AHAM 804 can be removed and replaced by a new AHAM module 814 having an updated electronics module 816 and presence activation device 818 in the form of a RFID reader as shown in dashed lines in FIG. 8. By making the AHAMs 804; 818 interchangeable with the HPT module 802 a user can easily update the MHAD 800 with improved electronics without having to purchase an entire hearing aid. Because the AHAM module 814 includes a RFID reader that interacts with the RFID tag of the HPT module 802 the AHAM module 814 is automatically configured to the user's 803 hearing deficiency by receiving setting data, such as an HLP, from the RFID tag in the HPT module 802, as discussed in detail above with regard to other embodiments. Furthermore, because the HPT module 802 comprises an ear-molded portion of the MHAD 800 the electronics are easily updated without the need of a new fitting. Thus, it is contemplated that a user who presently has an HPT module 802 could simply purchase a AHAM 804 through various means, such as directly from the manufacturer, online, through a 1-800 number, etc. and have the AHAM 804 automatically configure its settings to the user's needs.

It is contemplated that the MHAD 804 is configured for a variety of hearing aid styles. For example, the AHAM housing 808 could be produced in a modular format that is capable of fitting a BTE hearing aid, an ITE hearing aid, as well as other styles. This would allow the manufacturer of the AHAM 804 to produce the AHAM 804 for use in a variety of models and achieve economies of scale.

Figure 9:
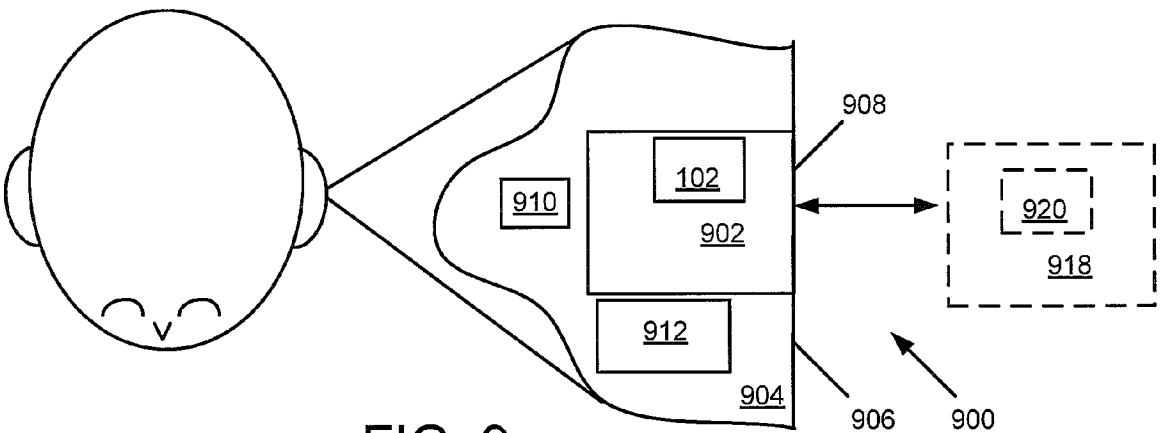
FIG. 9 shows an exemplary embodiment of an Automatically Configuring Hearing Assistive System.

FIG. 9 shows an alternative embodiment of a MHAD 900 also in the form of an ITE hearing aid in which the components of the ear molded piece and the interchangeable piece discussed above are largely reversed. For example, in the embodiment shown in FIG. 9 the AHAM 904 is provided as part of an ear molded shell 906 and the HPT module 902 is provided on a releasably engagable housing. In this case the AHAM 904 includes essentially the same components discussed above with regard to the AHAM 804 of FIG. 8 including an electronics module 912 and a presence activation device 910 in the form of an RFID reader. Likewise, the HPT module 902 includes similar components as the HPT module 802 discussed above with reference to FIG. 8 and includes an HPT 102 in the form of an RFID tag that includes setting data. The AHAM 904 and the HPT module 902 interact as discussed above so that setting data, such as an HLP, can be received by the AHAM 904 and the AHAM 904 adjusted accordingly.

The AHAM 904 and the HPT module 902 are releasably engagable so that the HPT module 902 can be removed and replaced by a second HPT module 918 shown in dashed lines having a second HPT 920 in the form of an RFID tag. The interchangeability of HPT modules 902; 918 allows a user to easily configure the AHAM 904 to a new hearing prescription. For example, a user can take a hearing test and obtain a new HLP. The new HLP can then be added to an HPT module 918 and the present HPT module 902 replaced by the new HPT module 918 so that the AHAM 904 is configured to the new prescription.

It is contemplated that hearing exams can be administered by a variety of means such as, for example, through a computer kiosk, or through an internet based application. An HLP can be provided by these applications. Other means can be used to provide a user with a HLP in some format, such as an internet download or email attachment. With the HLP in hand, a user can then purchase an HPT with the user's HLP. For example, it is contemplated that HPT modules could be made available by a wide variety of sources such as discount stores, by mail order, online, or other means, much in the way that contact lens having particular prescriptions are now sold. The HLP can then be used to program an HPT such as an RFID tag as is known in the art. The user could purchase an HPT module 902 with the appropriate HLP and engage it with the AHAM 904 ear molded portion. The AHAM 904 would then configure itself to the HLP using the RFID tag 920 of the new HPT module 918 as discussed above. Furthermore a user could purchase several HPT modules 904 which are tailored to specific environments. When a user plans to enter a particular environment he can select an associated HPT module for that environment and engage it with the AHAM module. Thus, it is contemplated that hearing exams that provide HLPs and HPT modules having a variety of HLPs could be made widely available through a variety of sources and provide means for a user to configure a hearing aid to the user's particular needs without the assistance of an audiologist to configure the electronics or mold the shells.

Figure 10:
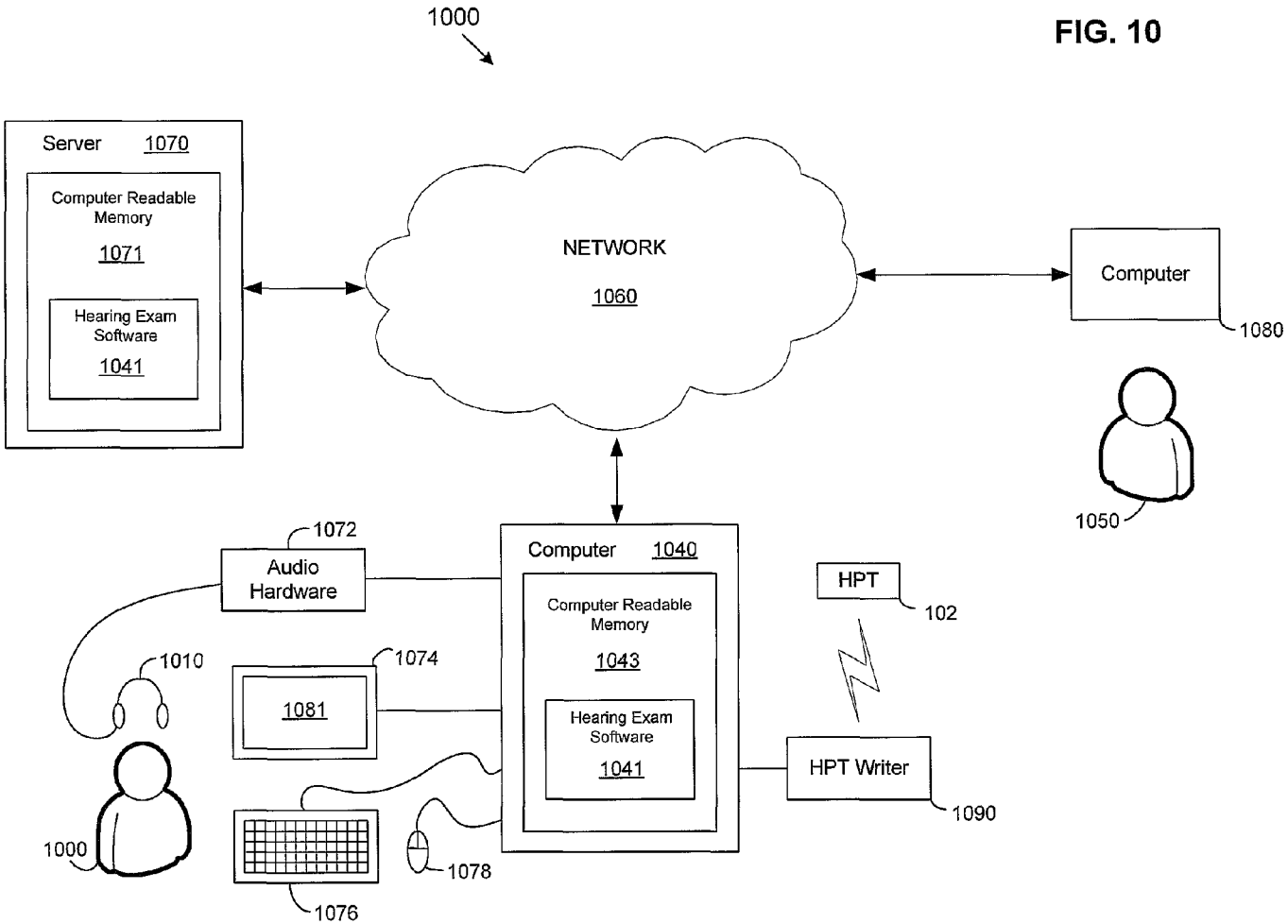
FIG. 10 shows a user using headphones and a computer in connection with a hearing exam, and related networked components.

Referring now to FIG. 10, a user 1000 wearing the headphones 1010 can take a hearing exam using a computer 1040. The user can be assisted or can perform the exam procedures on their own. Hearing exam software 1041 can be stored on a computer readable memory 1043 of the computer 1040, a computer located remotely, a removable memory media such as a CD-ROM, floppy disk, and the like, or any combination thereof. For example, the hearing exam software can be stored on a computer readable memory 1071 of a server 1070 connected to a network 1060. The software can be executed on the computer 1040, for example, through a plug-in application for a web browser. Headphones 1010 can have certain audio and electrical characteristics that are known to the hearing exam software. The exam software can additionally be aware of audio and electrical characteristics of audio hardware 1072 in the computer 1040, such as a sound card. The hearing exam software can adjust the hearing exam based on the audio and electrical characteristics of the headphones and audio hardware. The hearing exam conducted using the computer 1040 and the hearing exam software 1041 can comprise text instructions displayed on the monitor 1074 of the computer 1040, or speech instructions played through the headphones 1010, or both.

As is known in the art, audiometers can be used to conduct hearing exams. A hearing exam according to the present invention can include audiometer simulation software capable of generating tones that are output to headphones 1010 in response to which the user 1000 is instructed to make indications and selections using an input device of the computer 1040 such as a keyboard 1076, pointing device 1078, touch screen 1081, and the like.

The hearing exam software can collect data from the hearing exam. The data can be used to generate an HLP based on the hearing exam. The hearing exam software or some other software program on the computer 1040 or on a remote computer can use the data to generate the HLP. The resulting HLP can then be used to write the HLP to an HPT using the HPT writer 1090. Alternatively, or in addition, the invented method described can be used to update an HLP of a hearing aid that includes a connection such as a serial, USB, IEEE 1394 (Firewire), or other connection known in the art.

Optionally, after the hearing exam is completed, the results can be sent to an audiologist 1050 over a network 1060 so that the audiologist can, for example, analyze the results, modify the HLP if needed, and save the results to the computer 1080, or an HLP server 1070, or both. The audiologist 1050 can, for example, send the new HLP back to the user 1000 so that the user (or an assistant) can write the HLP via the HPT writer 1090.

A database of HLPs can be provided for download. HLPs in the database can comprise HLPs based on previous hearing tests and/or base HLPs (standard HLPs designed to correct common hearing loss patterns). These HLPs can be modifiable frequency profiles. This can allow the user and/or an audiologist to easily access numerous HLPs which can be used to update the HPT.

Figure 11:
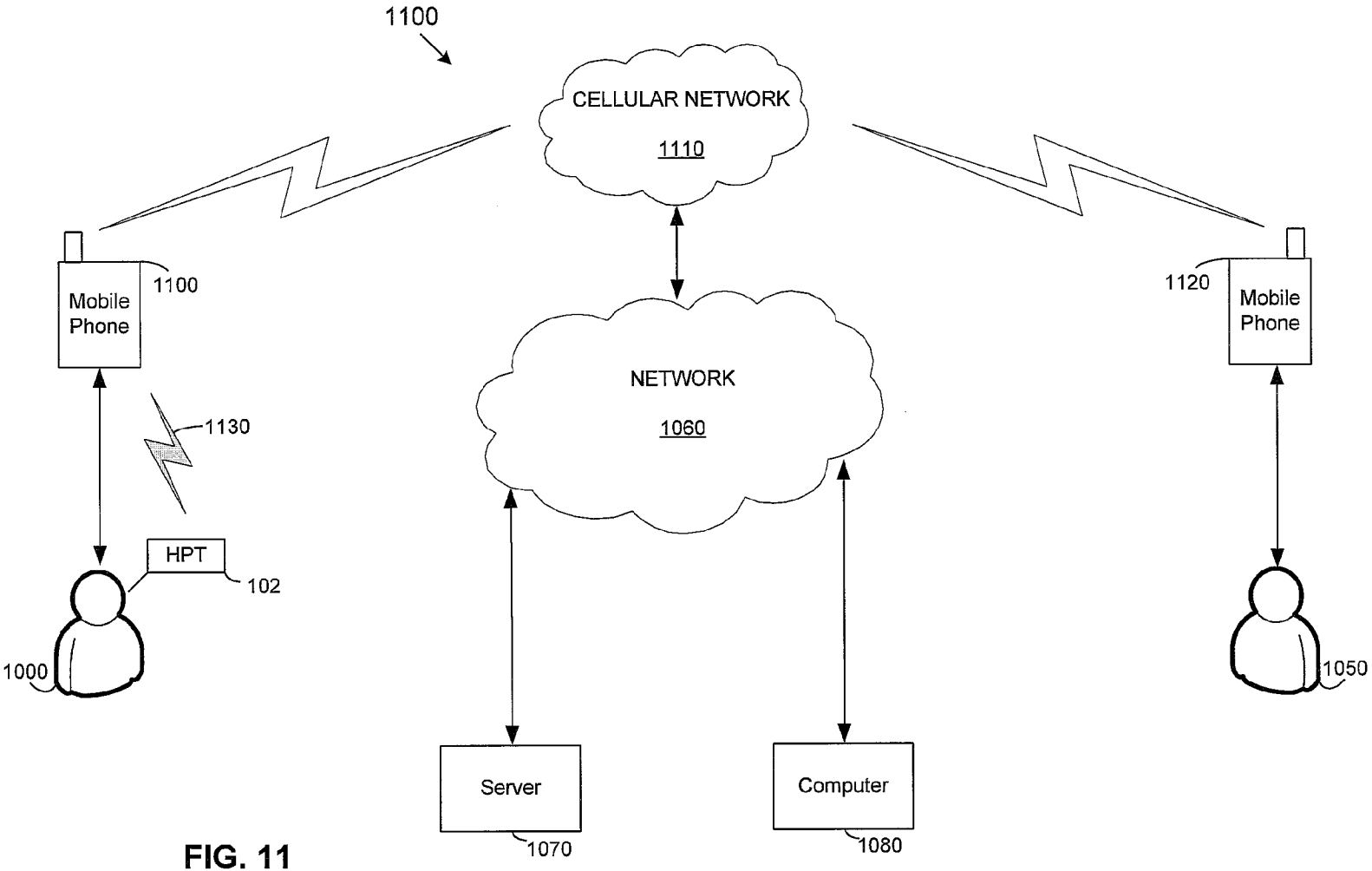
FIG. 11 shows a user communicating via a network with a third party for updating or changing settings associated with his or her hearing loss profile.

Referring now to FIG. 11, the user 1000 may need to update/change his or her HLP to improve hearing aid operation in certain environments. For example, a user 1000 with a Bluetooth compatible HPT 102 and a Bluetooth-enabled mobile phone 1100 enters an environment where the user's current HLP settings are not ideal. The user 1000 can call an audiologist 1050 and describe the problem. The audiologist 1050 can obtain HLP records for the user from a computer 1080 connected to a network 1060, an HLP server 1070 also connected to a network 1060, or both. Alternatively, the current HLP of the HPT 102 can be transmitted to the audiologist 1050 via the network 1060. The audiologist 1050 can then choose an HLP (or modify an HLP) to address ther user's hearing issue and send this HLP to the user's mobile phone 1100 via the computer network 1060 and the cellular network 1110. After the HLP is received by the user 1000, the user can update the HPT 102 on the hearing aid device by sending the newly acquired HLP from the user's Bluetooth-enabled mobile phone 1100 via a Bluetooth connection 1130 to the HPT 102. In some embodiments, an HPT is not required where a Bluetooth compatible hearing aid device is used. In such embodiments, the hearing aid can interact to transfer HLP information with the Bluetooth-enabled mobile phone. It is also contemplated that, in some embodiments, the hearing aid device can be connected to the mobile phone via a wired USB connection, or similar means for connection where Bluetooth or some other short range wireless transfer would not be required.

In some embodiments, interaction with an audiologist is not required to update the HPT. A new or adjusted HLP can be obtained by the user interfacing with a telephone menu tree, a web server, and/or a program stored on the mobile phone 1100. For example, an automated phone answering system can be implemented. The user 1000 can call a phone number and receive instructions to choose from a set of menu options corresponding to the numbers on the user's mobile phone 1100, or interact with a voice-recognition system capable of understanding a user's vocal requests. These or other methods known in the art can be implemented to allow the user 1000 to select an HLP based on the user's hearing exam records, the user's current environment, the current sub-optimum hearing issue, or any combination thereof.

The user 1000 can also choose to download hearing exam software and be administered a hearing exam over the user's mobile phone 1100. The hearing exam software can incorporate many of the same features as described in the hearing exam software for a computer 1040, in addition to software specific to the requirements of the user's mobile phone 1100. For example, software can be designed to identify the make and model of a mobile phone and optimize the performance of the hearing exam based on the fidelity of a mobile phone's sound chip and speaker(s) based on this information. The results of the hearing exam can be analyzed by the software which can provide at least one HLP suitable for the user's hearing loss in a given environment. It is contemplated that these methods and a variety of other methods derived therefrom can be incorporated to provide the user with HLP information, or hearing exam data, or both, via a network.

Figure 12:
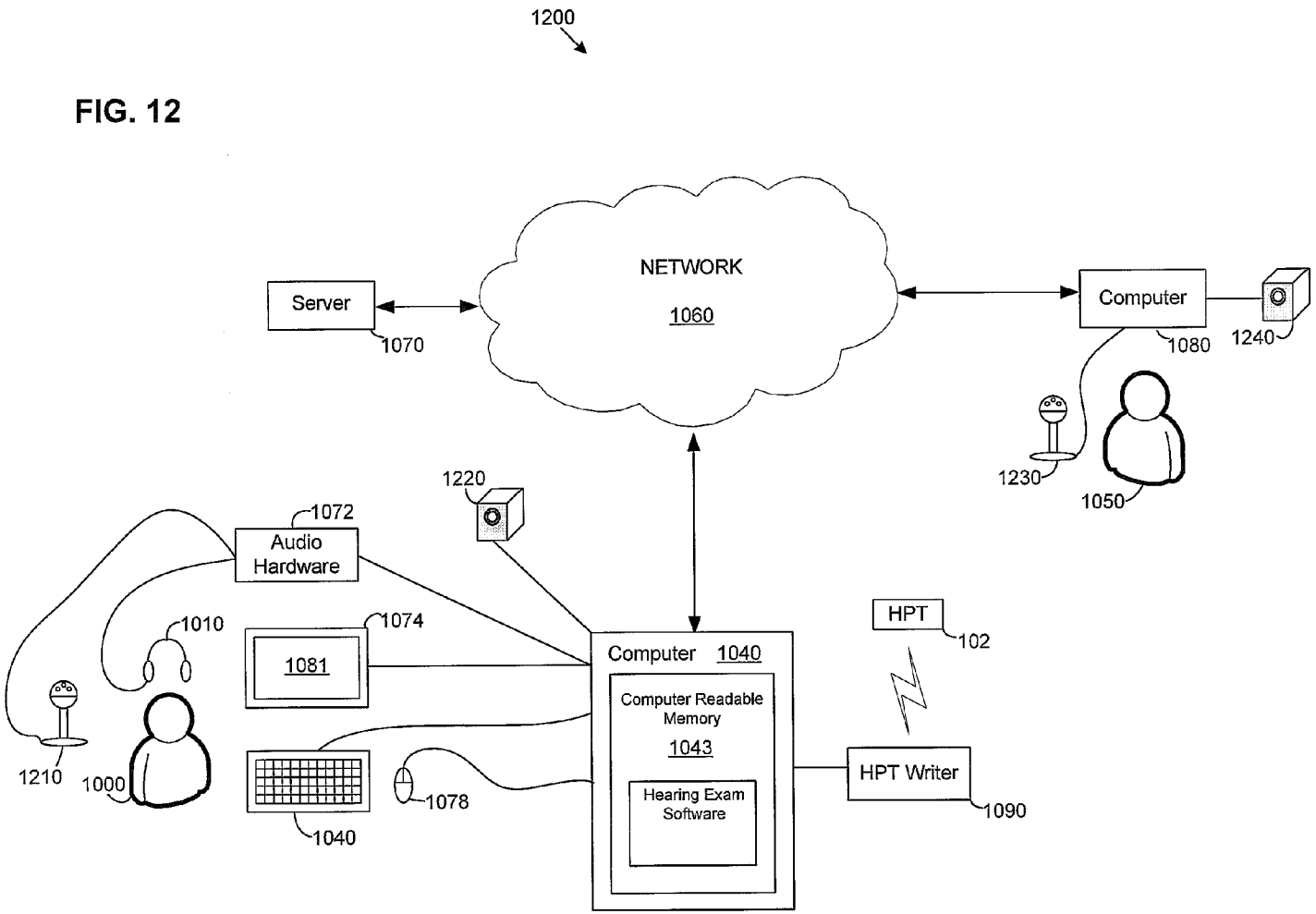
FIG. 12 shows administration of a remote hearing exam.

Referring to FIG. 12, a conferencing system 1200 can be implemented to allow an audiologist 1050 to administer hearing exams remotely to a user 1000. The conferencing system 1200 can include an audio feed, and in some embodiments can also include a video feed. The user's side of the conferencing system 1200 can include a pair of headphones 1010 and a device that allows the user 1000 to communicate a response via a network 1060 to the audiologist 1050, such as a microphone 1210, video camera 1220, or a keyboard connected to a computer 1040. The audiologist's side of the conferencing system 1200 can include a computer 1080 connected to the network 1060 so that the audiologist 1050 can send information to and receive information from the user 1040, such as a microphone 1230, a video camera 1240, or any combination thereof. The hearing exam software can be installed on the user's computer 1040, on the audiologist's computer 1080, or can be made available from another source such as a website or server 1070 connected to the network 1060. The conferencing system 1200 allows for the audiologist 1050 to be available in the event the user 1040 needs assistance during the hearing exam. This can benefit individuals who are not computer savvy or those who find additional comfort if an audiologist is available. This can also benefit the audiologist 1050 in establishing and maintaining a relationship with their patients, regardless of their physical location.

The law does not require and it is economically prohibitive to illustrate and teach every possible embodiment of the present claims. Hence, the above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

What is claimed is:

1. A hearing assistive device, comprising:

a housing molded to fit in an ear of a user of the hearing assistive device, the housing including a hearing profile tag module adapted to provide setting data; and an adjustable hearing assistive module adapted to receive the setting data from the hearing profile tag module;

wherein the housing and the adjustable hearing assistive module are releasably engageable so that the adjustable hearing assistive module can be readily removed from the housing and the adjustable hearing assistive module can be replaced into the housing or another adjustable hearing assistive module can be placed into the housing; and wherein the adjustable hearing assistive module comprises:

a presence activation sensor adapted to activate the adjustable hearing assistive module to receive setting data from the hearing profile tag module in response to detecting a presence of the hearing profile tag module;

hearing assistive circuitry adapted to receive and manipulate sound; and a controller coupled to the sensor and the hearing aid circuitry, the controller adapted to receive the setting data from the sensor and adjust the settings of the hearing aid circuitry to manipulate the sound in response to the setting data.

2. The hearing assistive device of claim 1, wherein the presence activation sensor comprises an RFID reader.

3. A hearing assistive system, comprising:

a hearing profile tag comprising setting data for configuring the settings of a hearing assistive device; and an adjustable hearing assistive device adapted to receive the setting data from the hearing profile tag, the adjustable hearing assistive device adapted to receive sound and manipulate sound in response to the setting data;

wherein the adjustable hearing assistive device includes a presence activation sensor adapted to activate the adjustable hearing assistive device to receive setting data from the hearing profile tag module in response to detecting a presence of the hearing profile tag device; and wherein the presence activation sensor includes a triggering component selected from a group of triggering components consisting of:

a sound component;

a temperature component; and a moisture component.

4. The hearing assistive system of claim 3, wherein the hearing profile tag comprises an RFID tag.

5. The hearing assistive system of claim 3, wherein the setting data comprises a hearing loss profile.

6. The hearing assistive system of claim 3, wherein the hearing profile tag is attached to a personal accessory.

7. The hearing assistive system of claim 6, wherein the personal accessory is a pair of eyeglasses.

8. The hearing assistive system of claim 3, wherein the hearing profile tag comprises eyeglasses having a first tag on a first ear piece of a frame of the eyeglasses and a second tag on a second ear piece of the frame.

9. The hearing assistive system of claim 3, wherein the adjustable hearing assistive device comprises:

a receiver adapted to receive sound;

hearing processing circuitry adapted to manipulate the sound received by the receiver; and a controller coupled to the presence activation sensor and the hearing processing circuitry to receive the setting data from the presence activation sensor and to configure the hearing processing circuitry in response to the setting data.

10. The hearing assistive system of claim 3, wherein the presence activation sensor comprises an RFID reader.

11. The hearing assistive system of claim 9, wherein the hearing processing circuitry comprises:

a receiver to receive sound;

a converter to convert the sound to a digital signal;

a signal processor to manipulate the digital signal into a processed signal;

a converter to convert the processed signal to an analog signal; and a speaker to output the analog signal as sound waves.

12. The hearing assistive system of claim 11, wherein the receiver comprises a microphone.

13. The hearing assistive system of claim 11, wherein the receiver comprises a telecoil.

14. The hearing assistive system of claim 11, further comprising an amplifier.

15. The hearing assistive system of claim 3, wherein the adjustable hearing assistive device is configured to, in response to being activated, interrogate the hearing profile tag module for the setting data.

* * * * *